US009532627B2

(12) United States Patent
Marston et al.

(10) Patent No.: US 9,532,627 B2
(45) Date of Patent: Jan. 3, 2017

(54) APPARATUS AND KIT FOR INTERCHANGING BUTTON DESIGNS ON APPAREL AND OTHER GOODS

(75) Inventors: Yvonne Marston, North Hampton, NH (US); Paul Marston, North Hampton, NH (US)

(73) Assignee: Y & P MARSTON DESIGNS, LLC, Dover, NH (US)

( * ) Notice: Subject to any disclaimer, the term of this patent is extended or adjusted under 35 U.S.C. 154(b) by 0 days.

(21) Appl. No.: 13/976,568

(22) PCT Filed: Dec. 23, 2011

(86) PCT No.: PCT/US2011/067157

§ 371 (c)(1),
(2), (4) Date: Jun. 27, 2013

(87) PCT Pub. No.: WO2012/092185

PCT Pub. Date: Jul. 5, 2012

(65) Prior Publication Data

US 2013/0283571 A1 Oct. 31, 2013

Related U.S. Application Data

(60) Provisional application No. 61/428,187, filed on Dec. 29, 2010.

(51) Int. Cl.
*A44B 1/14* (2006.01)
*A44B 1/12* (2006.01)

(52) U.S. Cl.
CPC . *A44B 1/14* (2013.01); *A44B 1/12* (2013.01); *Y10T 24/367* (2015.01)

(58) Field of Classification Search
CPC ..... A44B 1/14; A44B 1/04; A44B 1/12; A44B 1/24; A44B 3/00; A41H 37/00; A41H 37/10
(Continued)

(56) References Cited

U.S. PATENT DOCUMENTS 351,341 A * 10/1886 Rowlands ..... 24/113 MP
358,080 A * 2/1887 Smith ..... 40/315
(Continued)

OTHER PUBLICATIONS

International Search Report issued for co-pending international application No. PCT/US2011/067157, mailed on Apr. 13, 2012.
(Continued)

*Primary Examiner* — Robert J Sandy
*Assistant Examiner* — Rowland Do
(74) *Attorney, Agent, or Firm* — Gearhart Law LLC

(57) ABSTRACT

Disclosed is a covering apparatus and kit for updating the style and fashion on buttons, fixtures and the like on various goods. The covering includes an elastomeric member that can be circular or any other shape and material such as fabric or other ornamental material. One advantage of the covering is the ability to easily insert and remove over any sized fixture and the ability to not only change fabric and ornamental style but shape to keep up to date with the latest fashion or styles. The shape of the covering can be adjusted in several ways including, but not limited to, utilizing an elastomeric member of a different shape, utilizing a frame member, utilizing the fabric itself or any of combinations thereof. The covering apparatus may also be utilized in a kit to allow a user to create various styles and combinations of the covering to meet individual requirements.

2 Claims, 8 Drawing Sheets

(58) Field of Classification Search
USPC ..... 24/113 MP, 113 R, 114.9, 114; 40/315; 16/433, 435; 2/209
See application file for complete search history.

(56) References Cited

U.S. PATENT DOCUMENTS

| | | | | | |
|---|---|---|---|---|---|
| 379,289 | A | * | 3/1888 | Schmahl | 40/315 |
| 1,658,514 | A | * | 2/1928 | Carp et al. | 24/113 MP |
| 1,867,424 | A | * | 7/1932 | Smith | 40/315 |
| 2,042,416 | A | * | 5/1936 | Weindel, Jr. | 40/662 |
| 2,067,814 | A | * | 1/1937 | Bangs | 24/113 MP |
| 2,189,467 | A | * | 2/1940 | Jacobs | 68/235 R |
| 2,751,654 | A | | 6/1956 | Armbruster | |
| 2,880,487 | A | | 4/1959 | Ryan | |
| 2,983,009 | A | | 5/1961 | Dritz | |
| 3,087,215 | A | * | 4/1963 | Tworek et al. | 24/113 R |
| 3,242,544 | A | | 3/1966 | Dritz | |
| 3,500,507 | A | * | 3/1970 | Malhenzie et al. | 24/113 MP |
| 3,648,331 | A | * | 3/1972 | Kruger et al. | 24/113 R |
| 4,471,510 | A | * | 9/1984 | DeRosa | 24/90.1 |
| RE32,500 | E | * | 9/1987 | Takata | 24/113 MP |
| 4,907,320 | A | * | 3/1990 | Miao | 24/101 R |
| 4,935,965 | A | * | 6/1990 | Wassell | 2/209 |
| 4,941,234 | A | * | 7/1990 | Watanabe et al. | 24/113 MP |
| 5,033,168 | A | * | 7/1991 | Sbragi | 24/113 MP |
| 5,255,417 | A | * | 10/1993 | Herman | 24/113 MP |
| 5,315,739 | A | * | 5/1994 | Herman | 24/113 MP |
| 5,394,719 | A | * | 3/1995 | Fang | 63/33 |
| 5,428,867 | A | * | 7/1995 | Hannerstig | 16/87.2 |
| 5,513,422 | A | * | 5/1996 | Wen-Lung | 24/92 |
| 5,526,551 | A | | 6/1996 | Herman | |
| 5,542,157 | A | * | 8/1996 | Herman | 24/113 MP |
| D396,202 | S | * | 7/1998 | Lindsay | D11/228 |
| 5,778,455 | A | * | 7/1998 | Joseph | 2/209 |
| 5,956,816 | A | * | 9/1999 | McCrink | 24/113 MP |
| 6,035,494 | A | * | 3/2000 | Duke et al. | 24/113 R |
| 6,848,122 | B1 | * | 2/2005 | Meeds | 2/422 |
| 7,228,598 | B1 | * | 6/2007 | Powers | 24/113 R |
| 2002/0023283 | A1 | * | 2/2002 | Kania et al. | 2/2.15 |
| 2003/0008937 | A1 | * | 1/2003 | Lever et al. | 523/122 |
| 2004/0034971 | A1 | | 2/2004 | Bagot | |
| 2004/0226145 | A1 | * | 11/2004 | Ouellette et al. | 24/113 MP |
| 2008/0313864 | A1 | | 12/2008 | Suter | |
| 2010/0236028 | A1 | * | 9/2010 | Clark | 24/113 R |
| 2012/0030863 | A1 | * | 2/2012 | Marasco et al. | 2/243.1 |

OTHER PUBLICATIONS

International Preliminary Report on Patentability and Written Opinion, issued in related international application, PCT/US2011//067157, issued on Jul. 2, 2013.

* cited by examiner

APPARATUS AND KIT FOR INTERCHANGING BUTTON DESIGNS ON APPAREL AND OTHER GOODS

FIELD OF THE INVENTION

The disclosed embodiments relate generally to an apparatus and kit for interchanging button designs and fabric on apparel and other goods. More particularly, the disclosed embodiments relate to an apparatus and kit users can utilize to quickly and easily change the look of garments, home textiles, cabinetry and the like.

BACKGROUND OF THE INVENTION

The fashion and style industry produce many different products each year. Even in industries beyond the fashion industry, manufacturers consistently change the style of their products in an attempt to further improve their product offerings.

Many times the underlying product of an outdated style is still functional and only the appearance is undesired. In the apparel industry, often times a simple change, for example, in the buttons, may make an out of date fashion in style again with today's latest look and feel. Prior art devices have attempted to make an interchangeable button or fixture with unsuccessful results.

For example, U.S. Pat. No. 2,751,654 discloses an ornamental cover for a sewed button plate. An arched top plate extends over a bottom button plate. The bottom button plate has a recess for a sewed button to be received within the recess. A lock lever hinged to the top plate secures the assembly over a button. However this prior art device is limited to the size of the locking device and what buttons may be covered by the button cover.

Further, U.S. Pat. No. 2,880,487 describes an interchangeable ornament for buttons having a substantially flat portion, and a V-shaped element that engages a button to fasten the ornament. This prior art device is limited in shape and sizes of the ornamental device. It also lacks the ability to securely fasten to a button or other object of various sizes.

Another example of a prior art device is shown in U.S. Pat. No. 2,983,009 that discloses a button having a shell like configuration with a top section having a pair of bendable fingers, and a bottom section. The fingers are bent to extend into a button when the top and bottom sections are assembled. The top section may be covered by material. The prior art device lacks the ability to easily disengage and re-engage a substitute cover. Once the shell like configuration is engaged it is difficult to remove.

Still another example is U.S. Pat. No. 3,242,544. Again, a button shell type configuration is disclosed. Also disclosed is a button back for forming a fabric-faced button. The button shell has a button back with a central opening and a flange. The shell and back is specifically dimensioned for the back to be telescoped and pressure-fitted into and to rest within the shell. The shell and back interlock in engagement with fabric material for the facing covering for the button. Again, the prior art device is specifically dimensioned for the button it covers and interchangeability of fabric is difficult.

Thus, there still remains a need in the field to provide an apparatus and kit for updating the styles of an apparel or other goods by using a covering that is interchangeable and inserts/removes relatively easily to update styles as needed. There also still remains a need in the art for an interchangeable cover that allows various shapes and sizes of ornamental or decorative coverings to be inserted/removed relatively easily to keep up with the changing styles.

SUMMARY AND OBJECTS OF THE INVENTION

The disclosed apparatus and kit provides for a novel way of providing a revitalize look and feel on apparel and other related or unrelated goods, such as cabinetry, and the like. Disclosed is an apparatus and kit that allows a user to reshape and design buttons, knobs, fixtures, and any other hardware that can utilize the invention.

One object of the invention is to provide an easy to use removable, and secure device to allow users to cover buttons and the like with a new ornamental cover. The device includes an elastomeric member to allow secure and removable fitting over any sized button or object. The device also includes material that is not limited to a specific composition, and can be selected from a wide variety of materials or combination of materials. The device also permits use of frames or other materials to change the shape of the cover so that the cover is not limited to a circular shape such as a button or knob fixture depending on the embodiment.

In another embodiment, a kit is provided to allow a user to create their own design and ornamentation. Among other things, the kit includes an elastomeric member, a fabric or other material and may or may not include other indicia for ornamentation that can be bonded on the fabric. The kit also includes an instructions for use manual to assist the user in utilizing the kit to make the covering. Examples of materials for the covering includes, but is not limited to, fabric, wool, cotton, polyblends, wovens, non-wovens, non-synthetics, synthetics, plastics, composites, metal alloys, metals, wood, paperboard, and any combination thereof.

Another embodiment includes utilizing a frame material to alter the shape of the covering. The covering is not limited to a circular shape and various methods and materials may be utilized to obtain the shape desired for the covering. In one embodiment a frame material in the desired shape is used and placed on the fabric so that the fabric can be disposed about the frame. The fabric is bonded to an elastomeric member or other such resilient member that will allow the covering to be securely placed over the button or other such fixture.

In addition, the fabric may be bonded directly to the elastomeric member with the use of a frame or other such device. The fabric may be folded or bonded to an elastomeric member that has a pre-set configuration that would form the desired shape of the covering. For example, a triangular shaped elastomeric member may be utilized to attach to the button or fixture. The triangular elastomeric member may be also used to pre-set the shape of the covering in a triangular configuration.

An additional object of the present invention is minimizing the discomfort or time associated with using the covering device or kit by utilizing an easy to use and removable device that allows quick interchangeability without potential damage to the button or fixture. Many prior art devices due to their locking mechanisms were harmful to the underlying button or apparel and potentially would caused damage to the apparel. The current invention reduces the risk of harming the underlying apparel or fixtures by utilizing an elastomeric member in combination with fabric and other materials to minimize the risk of damage during removal.

The foregoing objects are achieved and other features and advantages of the present invention will become more apparent in light of the following detailed description of exemplary embodiments thereof, as illustrated in the accompanying drawings.

BRIEF DESCRIPTION OF THE DRAWINGS

In the drawings, wherein similar reference characters denote similar elements throughout the several views.

DETAILED DESCRIPTION

The invention will now be described in detail with reference to the accompanying drawings. The present invention relates to an apparatus and kit for altering the style of buttons, fixtures, and other hardware that can be covered by the covering apparatus. The present invention increases the flexibility in utilizing current goods and apparel by updating its style to today's fashion, look and feel. Typically, for example, if a sweater was out of date, a consumer may, depending on the circumstances, choose to purchase an updated version of the sweater even if the basic components of the sweater are still functional and not worn. The present invention allows a more robust use of consumer goods by allowing consumers to update their goods and even customize them by utilizing the disclosed covering apparatus and kit. By providing consumers with better flexibility in using their current goods and still keeping up to date in fashion or style, the present invention provides a cost effective way of revitalizing outdated or out of style apparel and goods.

Figure 1:
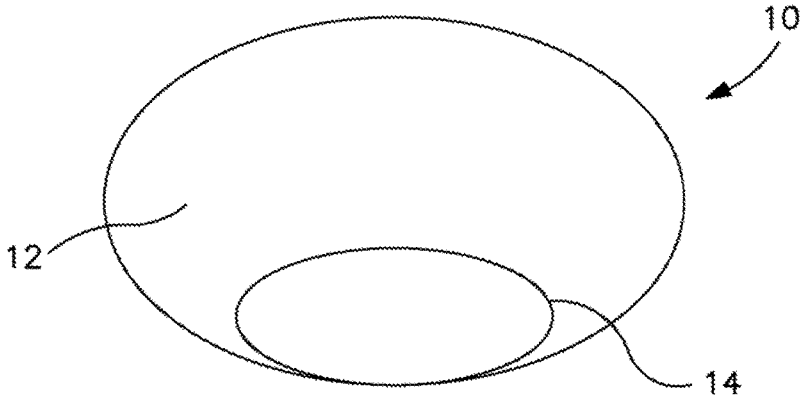
FIG. 1 shows a front perspective view of one embodiment of the apparatus.

Adverting to the drawings, FIG. 1 illustrates one embodiment of the invention. Shown is a covering apparatus 10. The apparatus 10 includes a sheath 12 and an elastomeric member 14. The sheath and the elastomeric member may or may not be integral depending on the embodiment. Furthermore, the elastomeric member may or may not be made of the same material as the sheath 12. Preferably, the sheath is a fabric like material, but is not so limited, and can vary depending on the style required by the user. The elastomeric member 14 is preferably a thermoplastic elastomer, but again is not so limited. The elastomeric member contains physical properties that would allow it to expand and constrict for many cycles, and preferably be durable through multiple washes.

Figure 2A:
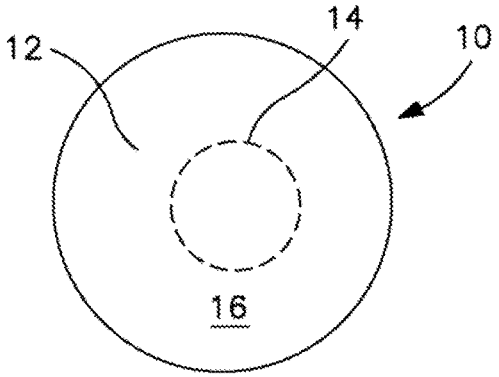
FIG. 2A shows a top view of the apparatus shown in FIG. 1.
Figure 2B:
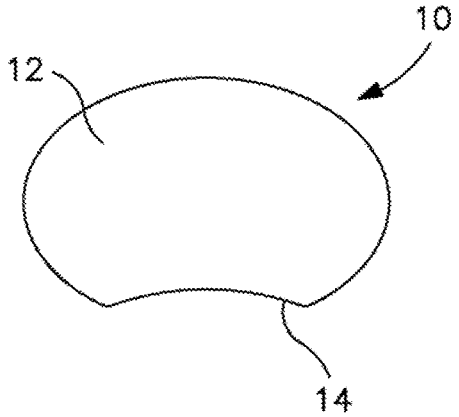
FIG. 2B shows a side view of the apparatus shown in FIG. 1.
Figure 2C:
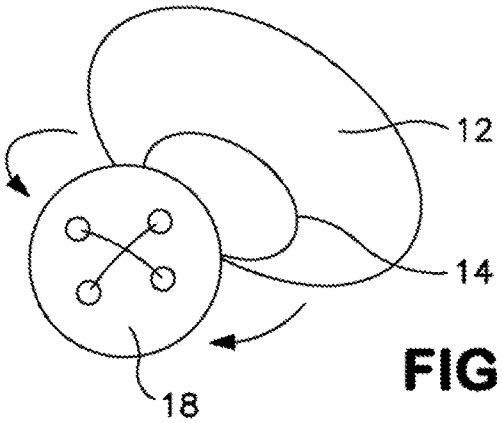
FIG. 2C shows bottom perspective view of the apparatus shown in FIG. 1 being used to cover a button.

FIG. 2A illustrates a top view of the covering apparatus 10. The elastomeric member 14 is hidden and so denoted. The sheath 12 is shown in a circular shape but is not so limited. The covering may be any shape desired by the user and can be formed by various methods as illustrated, but not so limited, by the example in the foregoing description. FIG. 2B illustrates a side view of FIG. 2A and shows that the area inside the sheath 12 is capable of holding any sized button or fixture. The elastomeric member 14 is used to securely mount the covering 10 on the button or fixture and as the need requires to remove the covering 10 to update it with another covering. FIG. 2C illustrates one embodiment of the invention being assembled over a button. The elastomeric member 14 stretches over the button and then constricts over the back of the button as to hold the device in place. The sheath completely covers the button, fixture or whatever component is being re-vitalized. Since as shown in FIG. 2C the old button is completely covered, a new style and look is presented. Depending on the embodiment, the material for the sheath may contain a film or coating that is an antimicrobial. This feature would allow additional benefits in the healthcare setting or in any environment that antimicrobial properties are needed.

Figure 3A:
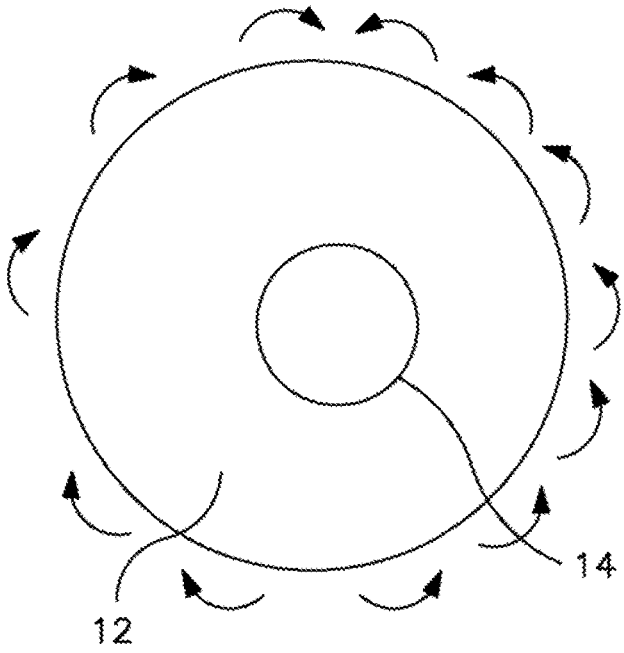
FIG. 3A shows a top view of another embodiment of the apparatus shown in FIG. 1 disassembled.
Figure 3B:
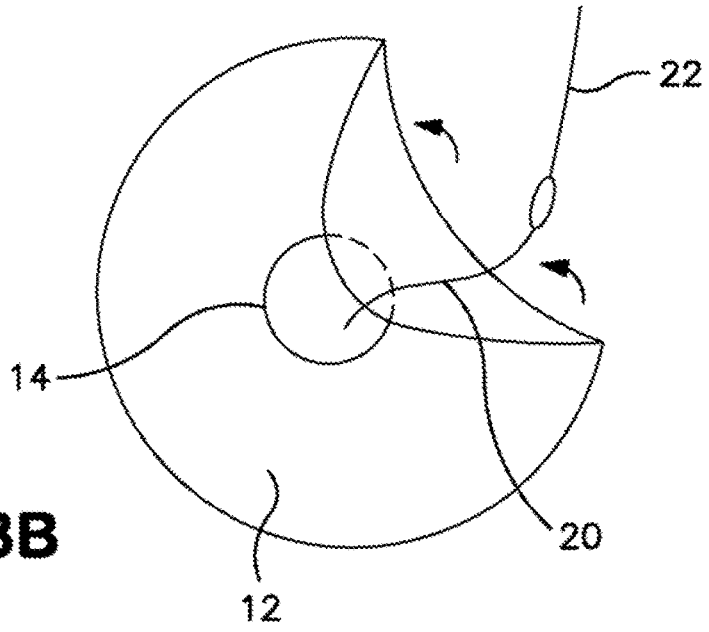
FIG. 3B shows a top view of the apparatus in FIG. 3A with one embodiment of assembly.

FIGS. 3A-3B illustrate one embodiment on how the device may be manufactured. The device of the present invention is flexible enough so that the end user may create their own individualized covering. Thus, depending on the embodiment, the covering may be purchased assembled or made with the end user. In the example given in FIGS. 3A-B, the elastomeric member 14 is placed in the center of sheath 12. The edges of the sheath are then folded over and under the elastomeric member and then bonded. The bonding may be done in various methods known to those skilled in the art and include, but are not limited to, sewing, ultrasonic welding, heat bonding, adhesives and any combination of the previous methods given. If the elastomeric member and the sheath are unitary, then no bonding would be required, unless there was an additional fabric bonded to the sheath.

Figure 4A:
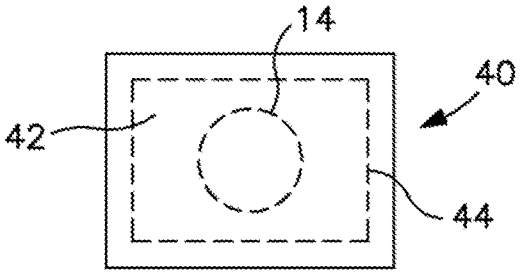
FIG. 4A shows a top view of one embodiment of the apparatus shown with a polygonal shape.
Figure 4B:
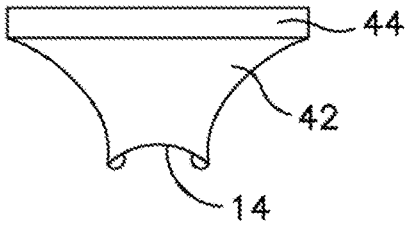
FIG. 4B shows a side view of the apparatus shown in FIG. 4A.
Figure 4C:
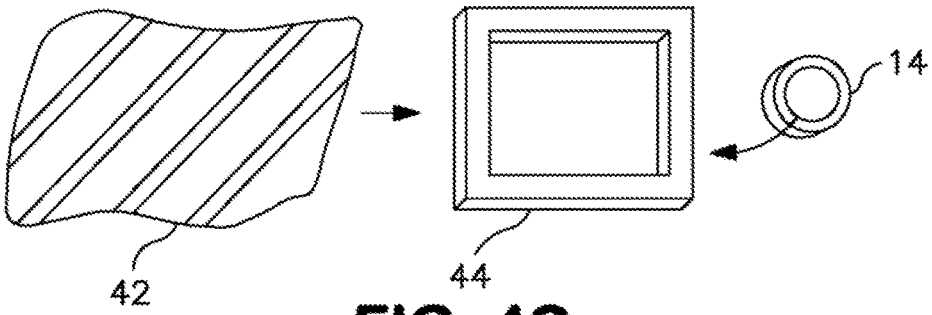
FIG. 4C shows a top perspective exploded view of the apparatus shown in FIG. 4A.

As previously illustrated the covering of the present invention is not limited to a circular shape and can be any shape desired by the end user. In FIGS. 4A-C illustrated is just one method in obtaining a non-circular covering shape. Frame 44 may be used with elastomeric member 14 placed in the center. Sheath 42 may be placed over the frame. Bonding may occur between the sheath and the elastomeric member, or sheath, frame, and elastomeric member depending on the embodiment and requirements of the end user. If the frame is not bonded, it may be reused with another covering if re-styling is required by the end user.

Figure 5A:
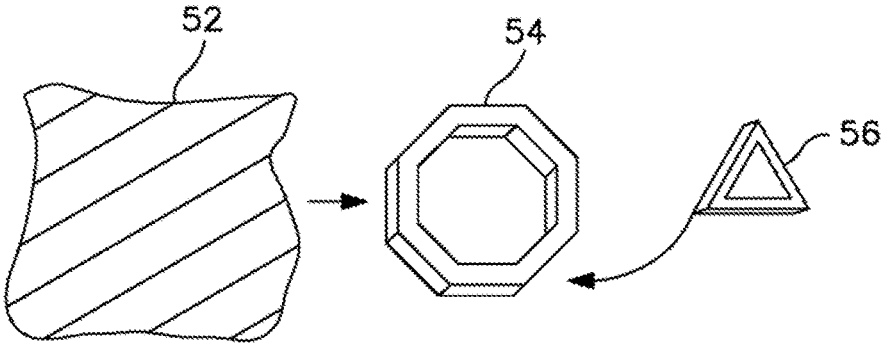
FIG. 5A shows a top perspective exploded view of another embodiment of the apparatus in FIG. 1.
Figure 5B:
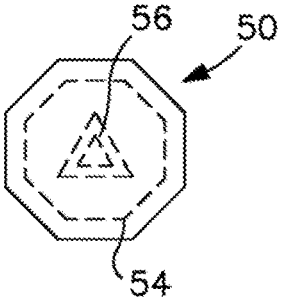
FIG. 5B shows a top assembled view of the apparatus shown in FIG. 5A.
Figure 5C:
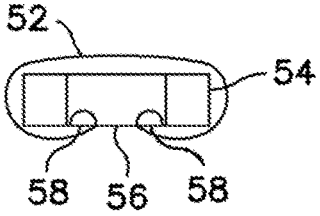
FIG. 5C shows a cross-sectional side view of the apparatus shown in FIG. 5B.

Furthermore, the elastomeric member is not limited to a circular configuration. As shown in FIGS. 5A-C, elastomeric member 56 is in a non-circular configuration. Frame 54 is utilized with sheath 52 to provide a covering 50 shaped in a polygonal configuration. Frames need not be used, depending on the embodiment, to achieve a non-circular configuration of the covering. Folding the sheath in a particular shape, or using a non-circular elastomeric member may also be used to obtain a non-circular configuration. Bonding as shown in FIG. 5C may occur to the elastomeric member only to allow reuse of the frame material. The objective is to provide a reusable covering that will be updated readily by the end user.

Figure 6:
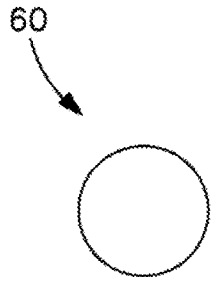
FIG. 6 shows a top view of a base layer on the apparatus shown in FIG. 1.
Figure 7:
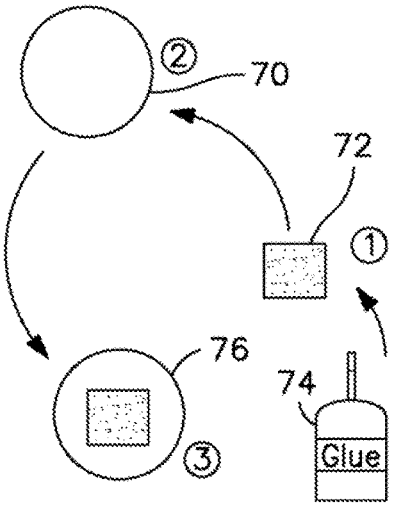
FIG. 7 shows a top view of the apparatus shown in FIG. 6 with a fabric being applied.

FIG. 6 illustrates a top view of a base covering 60. The base covering 60 may or may not contain an antimicrobial coating depending on the embodiment. As shown in FIG. 7, a fabric cutout 72 may be applied to the base covering 70 to produce a decorative covering 76. Depending on the embodiment the fabric cutout 72 may or may not be removable. In one embodiment, and adhesive 74 may be applied to the fabric cutout 72 to bond the cutout to the covering 70. Alternatively, a removable surface, such as but not limited to Velcro® may be used to allow the cutout to be replaced with other cutout material in the future.

Figure 8:
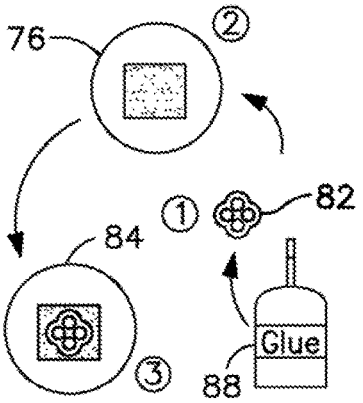
FIG. 8 shows a top view of the apparatus shown in FIG. 7 with addition hardware being applied to the fabric.

FIG. 8 illustrates a top view of adding additional ornamental components on the fabric cutout assembly 76. For example, indicia 82, may include but is not limited to, rhinestone, metal, plastic, glitter, and combinations of the previous, to add an additional layer of ornamental design to the covering 84. Again, depending on the embodiment, an adhesive 88, may or may not be used to bond the indicia to the assembly 76.

Figure 9:
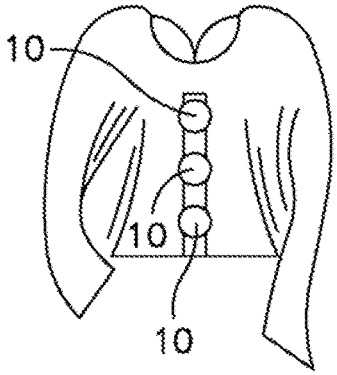
FIG. 9 shows an apparatus of the present invention being applied to apparel.
Figure 10:
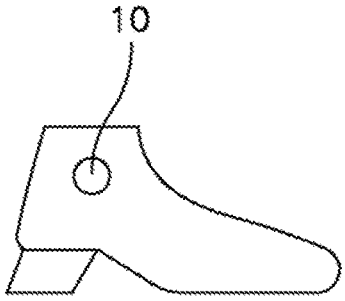
FIG. 10 shows an apparatus of the present invention being applied to foot wear.
Figure 12:
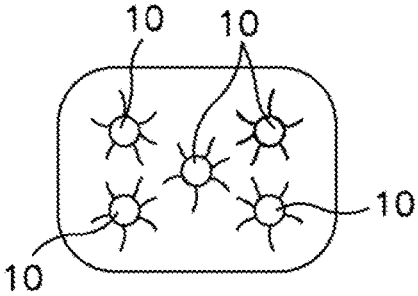
FIG. 12 shows an apparatus of the present invention being applied to a homes good, for example such as a pillow.
Figure 11:
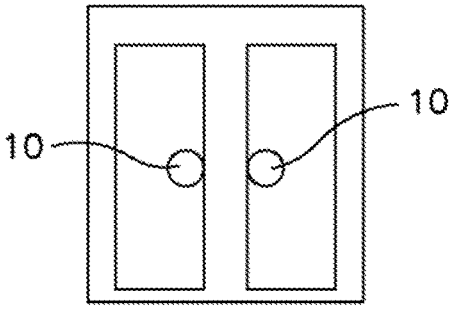
FIG. 11 shows an apparatus of the present invention being applied to cabinetry.
Figure 13:
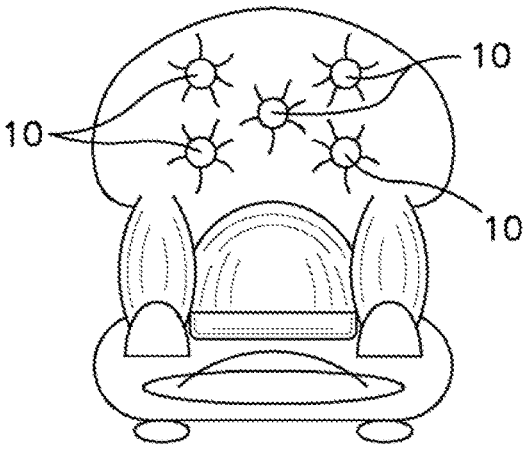
FIG. 13 shows an apparatus of the present invention being applied to a furniture, for example such as a chair.
Figure 14:
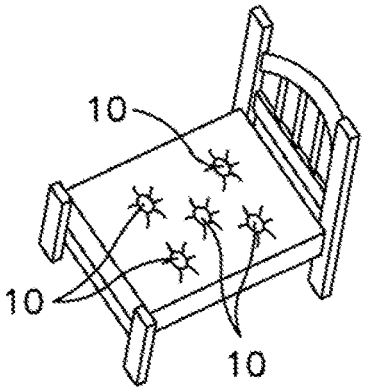
FIG. 14 shows an apparatus of the present invention being applied to bedding, for example such as a mattress.

FIG. 9 illustrates one embodiment where the covering of the present invention may be used. Shown is the device 10 on a sweater. FIG. 10 illustrates the use of device 10 on foot wear, where the foot wear has a button or fixture that may be covered. FIG. 11 illustrates the device 10 use on cabinetry doors. Knobs on any wood working may be updated by using the covering of the present invention. FIG. 12 illustrates the used of device 10 on a pillow or other home goods that contain buttons or other fixtures that may be covered. FIG. 13 illustrates use of device 10 on furniture such as a chair and FIG. 14 shows use on bedding such as a mattress. These examples are given as mere illustrations are not intended to limit the use of the device to these embodiments.

Figure 15:
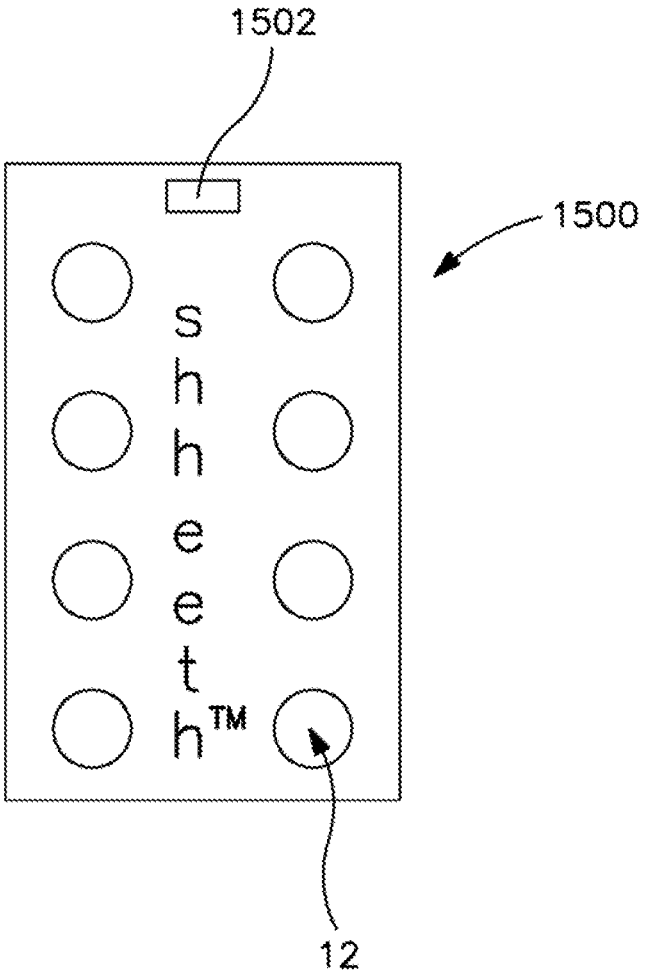
FIG. 15 one embodiment of the apparatus in FIG. 1 as a kit.

FIG. 15 illustrates one embodiment of a kit that an end user may obtain. The kit 1500 includes, depending on the embodiment, an instructions for use 1502, and at least one covering 12. The covering may or may not have the elastomeric member attached depending on the requirements of the end user. Ornamental indicia, and cut out fabric may also be included in the kit to allow the end user to customize the covering.

Figure 16:
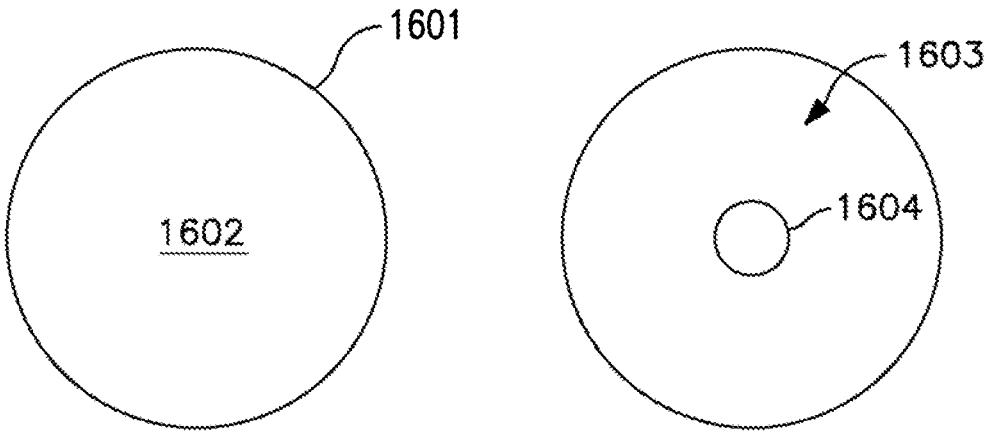
FIG. 16 shows an apparatus of the present invention utilizing two fabric disks.
Figure 17:
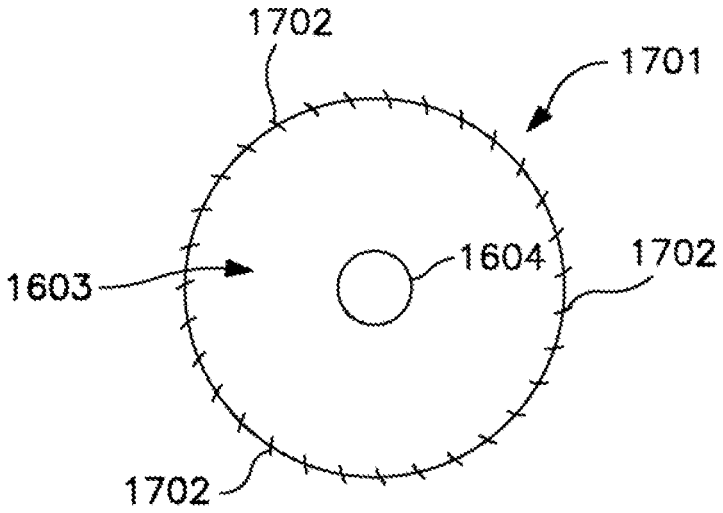
FIG. 17 shows the disks in FIG. 16 being assembled.
Figure 18:
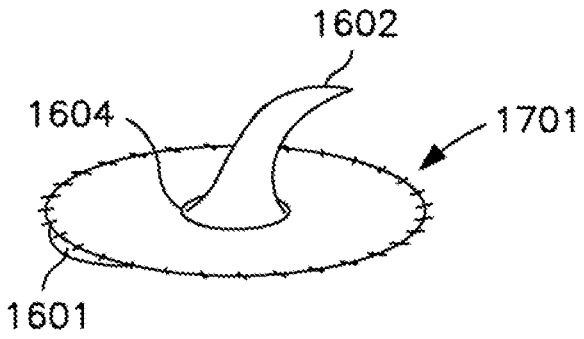
FIG. 18 shows the disks in FIG. 17 being pulled inside out.
Figure 19:
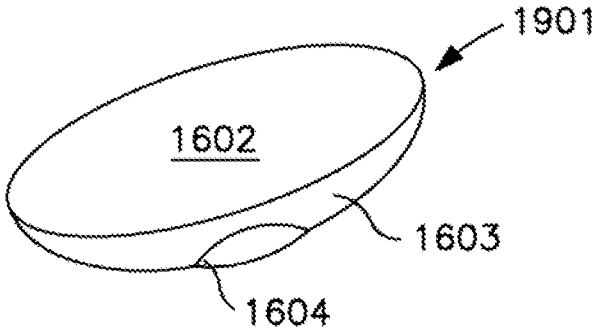
FIG. 19 shows the disks in FIG. 17 in its final form after being pulled inside out.

FIG. 16-19 illustrate a wrap made of two or more disks that is constructed inside out once the two sides of the disks are attached. The disks are preferably attached at the edges. The assembled wrap is turned outside for achieving the desired end look. Shown in FIG. 16 are two circular pieces of stretch fabric or the like. The material may be elastomeric, synthetic or natural woven or non-woven materials. The material should have the ability to stretch, however top section or disk 1601 may or may not be stretch fabric. Disk 1601 has a pattern or ornamental face 1602. The pattern may be any ornamental pattern or have any type of ornamental attachments. The face 1602 will be the front portion of the apparatus after assembly. Disk 1603 may or may not have ornamental features depending on the embodiment. FIG. 17 illustrates the assembly of the disks in FIG. 16. Disk 1603 is placed on top of disk 1601, thereby covering most of the ornamental features of face 1602. Disk 1603 defines a hole 1604 that enables viewing a portion of the ornamental design of disk 1601 and face 1602 when the disks are assembled: Disks 1601 and 1603 may be assembled by any means know to those skilled in the art including stitching, Velcro®, gluing, heat sealing and the like. Shown in FIG. 17 is assembled apparatus 1701 that combined disks 1601 and 1603. Assembly means 1702 connects the two disks together. The connection may or may not be permanent. If the connection means is not permanent, for example if the connection is releasable such as in a Velcro® example, then this particular embodiment and apparatus has the ability to switch out face 1602 and supply another ornamental face to provide various looks using the invention. FIG. 18 illustrates pulling the ornamental face 1602 of disk 1601 through hole 1604 of assembly 1701. In essence the assembly is being pulled inside out to hide the assembly means 1702. FIG. 19 illustrates the final form of the assembly 1701 with face 1602 in front and disk 1603 and hole 1604 in back of the assembly. The assembly 1701 can now be placed over a button or knob or the like through hole 1604 to provide the desired ornamental look. Various looks of the covering can be provided as previously discussed in detail.

Other alternative embodiments or implementations according to the various teachings of the present invention will be understood by those skilled in the art and achieved without departing from the spirit and scope of the invention. It is therefore intended that the present invention is not limited to the disclosed embodiments described herein but should be defined in accordance with the claims that follow.

We claim:

1. A covering apparatus used in altering the style of a button or fixture, comprising:

a first disk; said first disk being an elastomeric member having an ornamental design on one or both sides of the first disk; and a second disk; said second disk being an elastomeric member defining a hole, the first and second disk having flexibility to repeatedly expand over the button or fixture and contract over the button or fixture;

said first disk and said second disk having edges;

and the second disk being permanently connected to the first disk at the edges, the first disk being pulled through the hole of the second disk assembles the covering apparatus having an ornamental face and wherein the connection of the first disk to the second disk is hidden; and wherein the hole can be placed over the button or fixture thereby covering the button or fixture.

2. The covering apparatus in claim 1 wherein the connection between the first and second disks is releasable.

* * * * *